United States Patent [19]

Hagemann et al.

[11] 4,299,057

[45] Nov. 10, 1981

[54] WINDOW OPERATING ASSEMBLY

[75] Inventors: Edmund Hagemann, Wolfsburg; Herbert Wildschütte, Brunswick, both of Fed. Rep. of Germany

[73] Assignee: Volkswagenwerk AG, Wolfsburg, Fed. Rep. of Germany

[21] Appl. No.: 94,349

[22] Filed: Nov. 14, 1979

[30] Foreign Application Priority Data

Nov. 15, 1978 [DE] Fed. Rep. of Germany ..... 2849497

[51] Int. Cl.[3] ..... E05F 11/38

[52] U.S. Cl. ..... 49/375; 49/352

[58] Field of Search ..... 49/227, 374, 375, 348, 49/349, 423, 452, 502

[56] References Cited

U.S. PATENT DOCUMENTS

| | | | |
|---|---|---|---|
| 3,093,404 | 6/1963 | Probst | 49/227 X |
| 3,831,320 | 8/1974 | Dauernheim et al. | 49/352 |
| 3,930,339 | 1/1976 | Sander | 49/352 |

FOREIGN PATENT DOCUMENTS

| | | | |
|---|---|---|---|
| 619731 | 10/1935 | Fed. Rep. of Germany . | |
| 1771898 | 4/1958 | Fed. Rep. of Germany . | |
| 2313049 | 9/1974 | Fed. Rep. of Germany | 49/352 |
| 2458314 | 6/1976 | Fed. Rep. of Germany . | |
| 868658 | 5/1961 | United Kingdom | 49/375 |

*Primary Examiner*—Kenneth Downey
*Attorney, Agent, or Firm*—Spencer & Kaye

[57] ABSTRACT

A window crank assembly includes a guide rail mounted substantially parallel to the direction of motion of a window pane to be raised and lowered by the crank assembly; a sled mounted on the guide rail for back-and-forth travel thereon; a drive cable attached to the sled for moving the sled on the guide rail; a plug-and-socket joint for supporting a lower end of the guide rail for a pivotal motion about a lower foot point in a direction substantially perpendicular to the plane of the window pane; and a support for engaging the guide rail at a location thereof spaced from the lower end. The support defines a pivotal axis extending substantially perpendicularly to the plane of the window pane. The support holds the guide rail displaceably about the pivotal axis and shiftably parallel thereto prior to establishing connection of the guide rail with the plug-and-socket joint.

9 Claims, 7 Drawing Figures

Fig.1
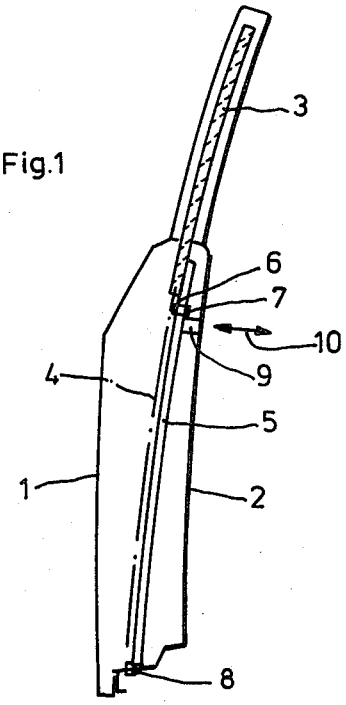
Fig.2
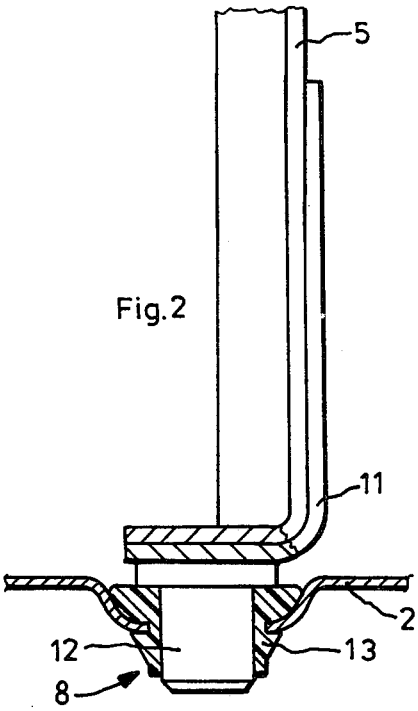
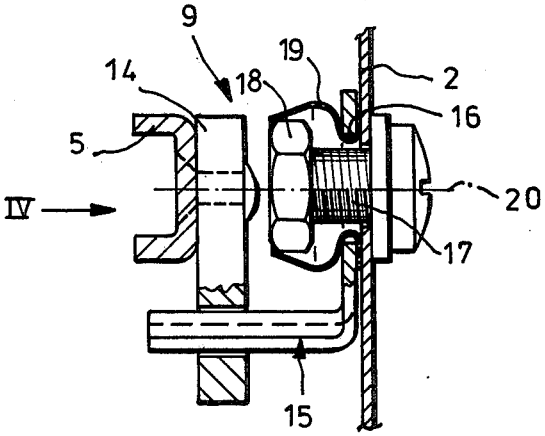
Fig.3
Fig.4
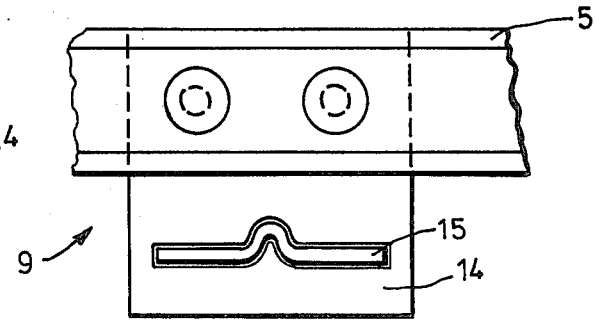

WINDOW OPERATING ASSEMBLY

BACKGROUND OF THE INVENTION

This invention relates to a window operating assembly which includes a cable connected with a drive, particularly a manually actuated crank and with a carriage which is arranged on a guide rail for back-and-forth travel. The guide rail is mounted substantially parallel to the direction of motion of the window pane.

A window crank assembly of the above-outlined type is disclosed, for example, in German Laid-Open Application (Offenlegungsschrift) No. 2,220,986.

Window crank assemblies of the above-outlined type generally find application for raising and lowering window panes mounted in vehicle doors. As a rule, for each particular door shape and dimension a particularly structured and adapted window crank assembly has to be used. Further, particular difficulties are encountered in case of window panes which are curved. Also, the manufacturing tolerances in the vehicle doors have been sources of problems regarding a trouble-free operation of the window crank assembly.

German Utility Model (Gebrauchsmuster) No. 1,771,898 discloses a window crank assembly having a resiliently yielding lifter arm. The lifter arm and the window pane are connected to one another by means of a bolt which extends perpendicularly to the plane of the window pane. A journal bearing is rotatably mounted on the bolt between springs. This structure however, may find application only in window crank assemblies operating with a lifter arm and cannot be used in cable-type crank assemblies in which a parallel guidance of the carriage has to be effected. Similar considerations apply to the known structures disclosed in German Pat. No. 619,731 and U.S. Pat. No. 3,930,339. The structure disclosed in the German patent includes a vertical threaded spindle on which there is mounted a traveling nut and which is rotatable by means of a crank. The nut is connected with the window pane by means of a member which is resilient perpendicularly to the plane of the window pane. By means of the resilient member it is, to be sure, feasible to compensate for distance variations and tolerances between the window pane on the one hand and the threaded spindle on the other hand; it is, however, not apparent how the nut can be prevented from rotating. The window crank assembly disclosed in the above-noted U.S. Pat. No. 3,930,339 has a threaded cable guided within a longitudinally slotted tube and is further provided with a nut member which is prevented by the slot from rotating and which has a cylindrical extension projecting through an eyelet of a lifter plate fixedly connected with the lower edge zone of the window pane. The cylindrical extension may slightly move axially, whereby tolerances may be compensated for. Further, the opening in the lifter plate is significantly greater in the horizontal direction than the corresponding dimension of the cylindrical extension so that transverse motions of the nut member may occur. This means that the cylindrical extension can transmit lifting motions to the window pane even when the cylindrical extension executes lateral excursions, rather than purely lifting motions.

Further, German Laid-Open Application (Offenlegungsschrift) No. 2,458,314 discloses a window crank assembly wherein the coupling between a cable forming part of a drive component and the window pane has a horizontal axis which extends parallel to the window pane, so that, particularly in case of curved window panes, changes of the angle of inclination between window pane and guide tube may occur.

SUMMARY OF THE INVENTION

It is an object of the invention to provide an improved window crank assembly of the above-outlined type which is of particularly simple construction and which, during installation in a door, sidewall or the like, automatically compensates for dimensional differences caused by tolerances or different designs.

This object and others to become apparent as the specification progresses, are accomplished by the invention, according to which, briefly stated, the guide rail of the crank assembly is mounted at its lower end by means of a plug-and-socket joint which permits pivotal motions of the guide rail about a lower foot point essentially perpendicularly to the plane of the window pane. At a higher location the guide rail is mounted by means of a support defining an axis which is substantially perpendicular to the plane of the window pane and about which the guide rail is pivotally and longitudinally displaceable prior to establishing the plug-and-socket connection.

Thus, in principle, the invention resides in mounting the guide rail not in a fixed manner in a door, side wall, or the like, but so that it is pivotally supported at a foot point for permitting a swinging motion in a given range such that it is pivotal in a direction which is perpendicular to the window pane.

The mounting of the guide rail can be achieved with simple means since the various components of the plug-and-socket joint may be pre-mounted and further because the support cooperating with a higher zone of the guide rail may also be structured in a simple manner.

BRIEF DESCRIPTION OF THE DRAWINGS

FIG. 1 is a schematic sectional view of a vehicle door incorporating the invention and taken in a plane which is perpendicular to the plane of the window pane.

FIG. 2 is a sectional elevational view of a part of a preferred embodiment of the invention.

FIG. 3 is a sectional top plan view of a detail of the preferred embodiment.

FIG. 4 is a view taken in the direction of the arrow IV of FIG. 3.

DESCRIPTION OF THE PREFERRED EMBODIMENT

Figure 5:
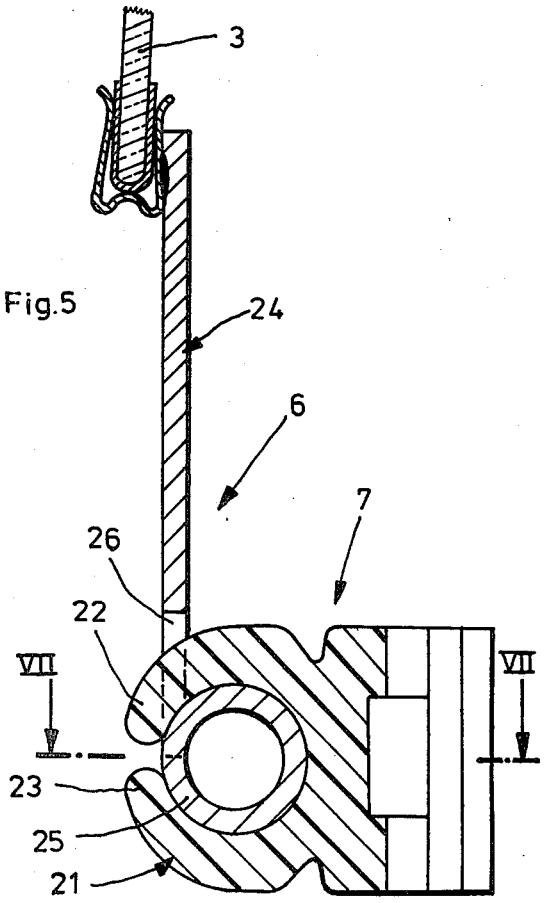
FIG. 5 is a sectional front elevational view of a further detail of the preferred embodiment.

Turning now to FIG. 1, there is shown an outer door plate 1, an inner door plate 2 and a window pane 3 which may be raised and lowered along the path 4 which may be curvilinear. For raising and lowering the window pane a window operating assembly is provided which comprises a guide rail 5 on which there is mounted a traveling sled 7 connected with the window pane 3 by means of a coupling arrangement 6. The sled 7 is attached to a cable which may extend in a flexible cable conduit and which couples the sled 7 with a drive (not shown), such as a manually operated crank lever or a drive motor.

According to the invention, the guide rail 5 is, at its lower end, mounted on the inner door plate 2 by means of a plug-and-socket joint 8 which permits pivotal motions of the guide rail 5 about a foot point or pivotal point determined by the plug-and-socket joint. In its upper zone the guide rail 5 is connected with the inner door plate 2 by means of a support 9 which permits the guide rail 5 to execute motions in that location only in the direction of the double-headed arrow 10, that is substantially perpendicularly to the plane of the window pane. As a result of this arrangement, the guide rail 5 can be adapted to various distances between the window pane 3 and the inner door plate 2. Such variations are caused by tolerances or different door sizes.

Turning now to FIG. 2, there are illustrated details of the plug-and-socket joint 8. It is noted that the guide rail 5 may have any arbitrary cross sectional shape; in the illustrated embodiment it has a U-shaped cross section. The guide rail 5 has a reinforcing sheet member 11 which, at its lower end, carries a pin 12 which projects into an elastic grommet 13 and is thus laterally supported, with the interposition of the grommet, by a lower zone of the inner door plate 2. It is thus seen that the pin 12 is the "plug" (or "head") and the grommet 13 is the "socket" of the plug-and-socket joint 8. By virtue of this arrangement, pivotal motions of the guide rail 5 about a pivotal point defined by the plug-and-socket joint 8 are possible and further, there are also admitted transversal motions of the guide rail 5 determined by the size and type of material of the elastic support grommet 13.

Turning now to FIGS. 3 and 4 there are shown details of the support 9 associated with a higher-lying portion of the guide rail 5. The guide rail 5 is connected with a slide member 14 provided with an opening through which passes a guide web 15. The latter, in turn, surrounds a threaded bolt 17 by means of an eyelet-shaped portion 16. The guide web 15 is prevented from sliding off the bolt 17 by means of a nut 18 and a securing member 19 which surrounds the nut 18 and, with an outwardly bent portion, extends between the plate 2 and the eyelet portion 16 of the guide web 15. In this manner a support arrangement is obtained which, prior to establishing the plug-and-socket joint 8, permits pivotal motions of the guide rail 5 about the axis 20 which coincides with the axis of the threaded bolt 17. After establishing the plug-and-socket joint 8, motions of the guide rail 5 are possible in the direction of the axis 20 by displacement of the slide member 14 on the guide web 15. This last-named displacement can thus be effected in the direction of the double-headed arrow 10 shown in FIG. 1.

Figure 6:
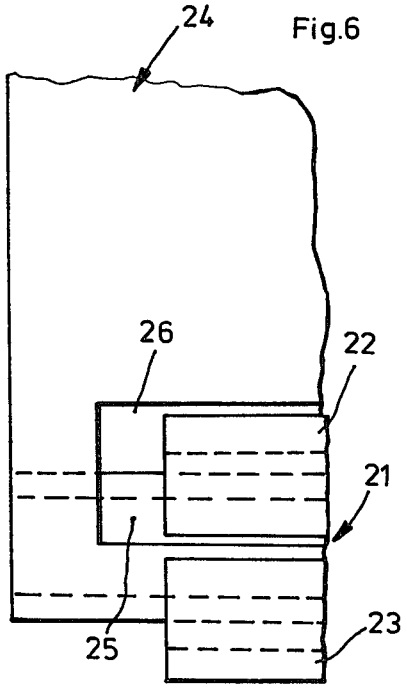
FIG. 6 is a side elevational view of the detail shown in FIG. 5.
Figure 7:
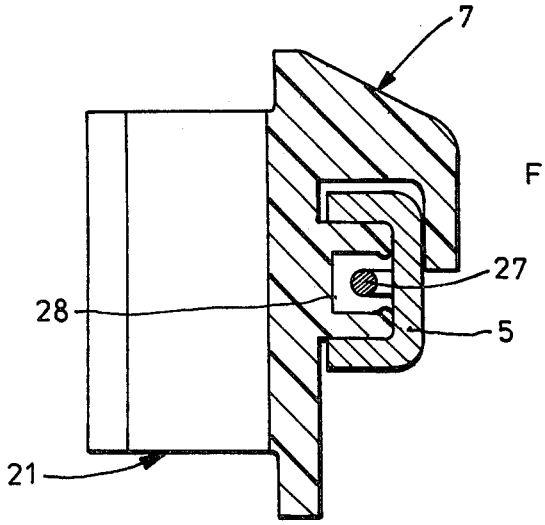
FIG. 7 is a sectional view taken along line VII—VII of FIG. 5.

Turning now to FIGS. 5, 6 and 7 there is illustrated in particular the connection 6 between the window pane 3 and the sled 7. The sled 7 forms a clamp 21 which has two lips 22 and 23 surrounding a hinge shaft 25 constituting a component of a lifter plate 24. The lifter plate 24 has an opening 26 through which the upper clamping lip 22 passes. The material removed to provide the opening 25 serves for forming the round and hollow hinge shaft 25. The sled, at least in the zone which includes the clamp 21, may consist of a resilient plastic such as PVC or ABS.

Turning now to FIG. 6, the opening 26 is wider than the clamp 21, so that transverse motions between the lifter plate 24 and the sled 7 are possible in addition to and independently from the relative pivotal motions about the hinge shaft 25. As shown in FIG. 7, the sled 7 is displaceable on the guide rail 5 in a known manner; thus, for this purpose, a cable 27 is attached at 28 to the sled 7 in the longitudinal direction.

By resorting to the above-described measures, there is thus provided an improved window crank assembly which, without noisy, chattering linkages and without parts exposed to wear provides, by the simplest mounting means, an automatic adaptation of the crank assembly to mounting environments which may differ because of curved window panes, tolerances or unlike designs in the door structures.

It will be understood that the above description of the present invention is susceptible to various modifications, changes and adaptations, and the same are intended to be comprehended within the meaning and range of equivalents of the appended claims.

What is claimed is:

1. In a window operating assembly for raising and lowering a window pane mounted in a wall structure; said assembly including mounting means; a guide rail secured to the wall structure by said mounting means; said guide rail assuming, in a secured, operative state, an orientation substantially parallel to the direction of motion of the window pane during a raising and lowering thereof; a sled mounted on the guide rail for back-and-forth travel thereon; connecting means for securing the sled to the window pane; and a drive cable attached to the sled for moving the sled on the guide rail; the improvement wherein said mounting means comprises (a) a plug-and-socket joint held in said wall structure and supporting a lower end of said guide rail; said plug-and-socket joint including first means for allowing said guide rail, in said secured, operative state thereof, to perform a pivotal motion in a direction substantially perpendicular to the plane of the window pane about a pivot point defined by said plug-and-socket joint; and (b) a support engaging said guide rail at a location thereof spaced from said lower end; said support including second means allowing said guide rail, in said secured, operative state thereof, to perform a freely sliding motion relative to said support in a direction substantially perpendicular to the plane of the window pane.

2. A window operating assembly as defined in claim 1, wherein said second means comprises a guide web immobilized in said door in the secured, operative state of said guide rail; said guide web having a guide portion oriented substantially perpendicularly to the plane of the window pane and a slide member affixed to said guide rail; said guide portion of said guide web slidably supported in an opening in said slide member.

3. A window operating assembly as defined in claim 2, further comprising a securing bolt attaching said support to said door; said guide web having an eyelet surrounding said bolt.

4. A window operating assembly as defined in claim 1, wherein said first means comprises a pin and an elastic grommet receiving said pin.

5. A window operating assembly as defined in claim 4, wherein said pin is affixed to said lower end of said guide rail and said grommet is held in said door.

6. A window operating assembly as defined in claim 1, wherein said connecting means for securing the sled to the window pane comprises a lifter plate attached to the window pane; a hinge shaft forming part of said lifter plate and being oriented parallel to the window pane and transversely to the direction of motion of the window pane; a clamp connecting said sled with said lifter plate; said clamp being carried by said sled; said clamp relatively rotatably surrounding said hinge shaft.

7. A window operating assembly as defined in claim 6, wherein said clamp is a resilient plastic; said clamp having a snapped-on relationship with said hinge shaft.

8. A window operating assembly as defined in claim 6, further comprising means defining an opening in said lifter plate adjacent said hinge shaft; said clamp having oppositely oriented lips surrounding said hinge shaft; one of said lips projecting through said opening.

9. A window operating assembly as defined in claim 8, wherein said opening has a dimension parallel to the hinge shaft; said dimension is greater than the width dimension of said lips measured parallel to the hinge shaft.

* * * * *